United States Patent [19]

Hyosu et al.

[11] Patent Number: 4,816,366

[45] Date of Patent: Mar. 28, 1989

[54] PROCESS FOR PRODUCING TONER THROUGH SUSPENSION POLYMERIZATION

[75] Inventors: Yoshihiko Hyosu, Machida; Takeshi Ikeda, Yokohama; Hitoshi Kanda, Yokohama; Hiromi Mori; Hiroaki Kawakami, both of Yokohama; Kuniko Kobayashi, Koganei, all of Japan

[73] Assignee: Canon Kabushiki Kaisha, Tokyo, Japan

[21] Appl. No.: 155,436

[22] Filed: Feb. 12, 1988

[30] Foreign Application Priority Data

Feb. 13, 1987 [JP] Japan ..... 62-29796

[51] Int. Cl.[4] ..... G03G 9/08

[52] U.S. Cl. ..... 430/137; 430/109

[58] Field of Search ..... 430/137, 109

[56] References Cited

U.S. PATENT DOCUMENTS 3,959,153 5/1976 Sadamatsu ..... 430/137

4,609,607 9/1986 Takagi et al. ..... 430/137 X 4,702,988 10/1987 Fukumoto et al. ..... 430/137

*Primary Examiner*—J. David Welsh

*Attorney, Agent, or Firm*—Fitzpatrick, Cella, Harper & Scinto

[57] ABSTRACT

A toner for developing electrostatic latent images is produced by a process comprising the steps of: (a) stirring at least water, hardly water-soluble inorganic fine powder and a specific compound thereby to prepare an aqueous dispersion medium; (b) adding a polymerizable monomer composition comprising at least a polymerizable monomer and a polymerization initiator to the aqueous dispersion medium; (c) forming particles of the polymerizable monomer composition in the aquoeus dispersion medium; (d) subjecting the particles of the polymerizable monomer composition to suspension polymerization, thereby to produce toner particles; and (e) removing the hardly water-soluble inorganic fine powder attached to the surfaces of the toner particles by an aqueous alkaline or acidic solution.

22 Claims, 1 Drawing Sheet

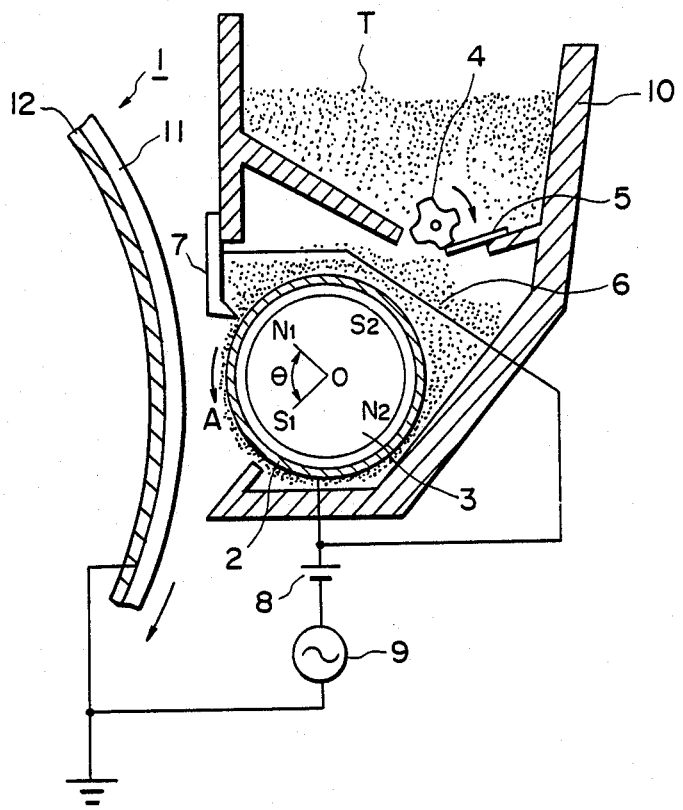
T
4
10
1
12
11
5
7
6
N1
S2
θ
O
A
S1
N2
3
2
8
9

PROCESS FOR PRODUCING TONER THROUGH SUSPENSION POLYMERIZATION

FIELD OF THE INVENTION AND RELATED ART

The present invention relates to a process for producing a toner for use in development of electrostatic latent images to provide visual images through suspension polymerization.

Conventionally, toners for developing electric or magnetic latent images have been used in various processes wherein toner images are formed and recorded.

As an electrophotographic process, i.e., one of such image-forming processes, a large number of processes have been known as described in U.S. Pat. No. 2,297,691, etc. Generally speaking, in these processes, electrical latent images are formed on a photosensitive member of photoconductive substance by various means and subsequently developed by use of a toner to form a toner image, and the toner image is optionally transferred onto a transfer material such as paper, and then fixed by heating, pressurization, heating and pressurization, or with solvent vapor to obtain copied products or prints. Conventionally, as a process for developing latent images by use of a toner or a process for fixing toner images, various processes have been proposed and appropriately adopted corresponding to respective image-forming processes.

Generally, toners used in the above mentioned process have been manufactured by fusion-mixing colorants such as magnetic materials, dyes or pigments into thermoplastic resins to be dispersed uniformly therein, followed by cooling, pulverization and classification into desired particle sizes by means of a micropulverizer and a classifier. This preparation method (pulverization process) is capable of producing considerably excellent toners but accompanied with potential problems such that the selection of the material therefor is rather limited. For example, a block of a resin composition in which a colorant is dispersed is required to be micropulverized by means of an economically usable production device. However, because the resin composition is fragile, particles having a wide range of particle sizes are easily produced when the resin composition is micro-pulverized at high speed. Particularly, there is posed a problem that a large amount of excessively pulverized fine particles are contained in the above-mentioned pulverized particles. Further, such fragile material is liable to be further pulverized in a developing apparatus of a copying machine.

Furthermore, in this pulverization process, it is extremely difficult to uniformly disperse solid fine particles such as magnetic powder or colorant in a resin. Therefore, sufficient attention must be paid to the degree of dispersion because increase in fog or decrease in image density can be caused in development depending on the degree of dispersion. Further, when the colorant is exposed from the cleavage surface of fine particles of the resin composition, the surface of a toner-carrying member can be stained in some cases.

Therefore, in order to overcome the problems of the pulverization process, it has been proposed to produce a toner through suspension polymerization.

In the suspension polymerization process proposed heretofore, a polymerizable monomer oomposition comprising at least a polymerizable monomer, a polymerization initiator and a colorant (optionally, further comprising an additive such as a crosslinking agent and a charge-controlling agent) is charged into an aqueous phase containing a suspension stabilizer, the polymerizable monomer composition is formed into particles under stirring, and the polymerizable monomer is polymerized to form toner particles.

This process has characteristics that the material used for the production of the toner particles is not required to have fragility and substantially no colorant is exposed from the cleavage surfaces of the toner particles because no pulverization step is involved. Further, the resultant toner has a shape close to a sphere to be excellent in fluidity, so that it has uniform triboelectric charging characteristic.

However, it is technically difficult to effect polymerization of a monomer composition by providing a system wherein particles of the monomer composition are stably suspended with little coalescence of the particles and to obtain fine polymer particles with a sharp particle size distribution.

Further, with respect to the toners used in processes for developing latent images, various characteristics must be controlled in order to faithfully reproduce an original image. Among these characteristics, the control of the distribution of toner particle size is one of the particularly important problems. For example, when there is used for image formation a toner which has a broad particle size distribution and contains a large amount of toner particles having a particle size out of a prescribed or defined range, the sharpness of the resultant image is impaired by scattering of the toner, fog or unevenness on the image. Further, the variation in the developing characteristics of the toner particles causes a problem of decrease in the toner durability.

In order to obtain a sharp particle size distribution in the suspension polymerization process, there have been proposed, e.g., a process wherein the particle size is controlled by using a combination of a dispersant and an anionic surfactant, as disclosed in Japanese Laid-Open Patent Application No. 42052/1982 (JP-A No. 57-42052); and a process wherein the particle size is controlled by adding a polymerization inhibitor for an aqueous phase, as disclosed in Japanese Laid-Open Patent Application No. 156839/1981 (JP-A No. 56-156839). However, a process for producing a toner through suspension polymerization capable of providing a more desirable particle size distribution is desired.

Incidentally, in a case where a surfactant such as an anionic surfactant is used as the dispersion stabilizer, the surfactant is liable to remain on the surfaces of toner particles because the surfactant is difficult to be removed by washing with water. As a result, such method has a problem that the developing characteristics of the toner is liable to be decreased by the surfactant.

In view of the above-mentioned problems, there is desired a process for producing a toner through suspension polymerization which provides sharp particle size distrbbution and uses a dispersion system little affecting the developing characteristics of a toner.

SUMMARY OF THE INVENTION

An object of the present invention is to provide a process for producing a toner through suspension polymerization (hereinafter sometimes referred to as "polymerization toner"), by which the problems of the prior art as described above have been solved.

A specific object of the present invention is to provide a process for producing a polymerization toner with a sharp particle size distribution.

Another object of the present invention is to provide a polymerization toner having excellent developing characteristics.

According to the present invention, there is provided a process for producing a toner through suspension polymerization, comprising:

(a) stirring at least water, hardly water-soluble inorganic fine powder and a compound selected from the group consisting of a silane coupling agent, a titanate-type coupling agent, an aluminate-type coupling agent, a zircoaluminate-type coupling agent and hydrolysis products thereof, thereby to prepare an aqueous dispersion medium;

(b) adding a polymerizable monomer composition comprising at least a polymerizable monomer and a polymerization initiator to the aqueous dispersion medium;

(c) forming particles of the polymerizable monomer composition in the aqueous dispersion medium;

(d) subjecting the particles of the polymerizable monomer composition to suspension polymerization, thereby to produce toner particles; and (e) removing the hardly water-soluble inorganic fine powder attached to the surfaces of the toner particles by an aqueous alkaline or acidic solution.

As a result of our study, it has been found that the coexistence of a specific compound with a hardly water-soluble inorganic fine powder dispersed in an aqueous dispersion medium, selectively stabilizes an association state wherein the fine powder is loosely agglomerated or aggregated, and enhances the ability of the fine powder for stabilizing a monomer composition particle (hereinafter sometimes referred to as "droplet") thereby to provide a polymerization toner having a sharp particle size distribution. The process for producing a polymerization toner according to the present invention is based on the above discovery.

Hereinbelow, the process for producing a toner according to the present invention will be described in more detail in comparison with the conventional process.

Generally speaking, in suspension polymerization, a polymerizable monomer composition is dispersed in an aqueous dispersion medium which is substantially mutually-insoluble with the monomer composition, and then polymerized thereby to form toner particles. In order to obtain polymerization toner particles having a sharp particle size distribution, it is extremely important problem how to stably hold the particle size of the droplets (particles of the polyerizable monomer composition), which have been suspended in the aqueous dispersion medium, uniform in a polymerization step.

As a means for solving such problem, our research group has previously proposed a process wherein inorganic fine powder such as silica is attached to the surfaces of polymerizable monomer composition particles to stabilize the particles, thereby to provide a toner having a sharp particle size distribution (U.S. Pat. No. 4,592,990).

As a result of our study for further stabilizing the polymerizable monomer composition particles, it has been found that the coexistence of a specific compound derived from a coupling agent with a hardly water-soluble inorganic fine powder dispersed in an aqueous dispersion medium considerably enhances the ability of the fine powder for stabilizing monomer composition particles (droplets) thereby to provide a polymerization toner having a sharp particle size distribution. Thus, we have reached the present invention.

According to our knowledge, the above-mentioned good stabilization of the droplets obtained in the present invention is assumed to be based on the following reason.

For example, a dispersant or dispersing agent comprising hydrophilic hardly water-soluble inorganic fine powder is dispersed in an aqueous dispersion medium in a state wherein the strong (or tight) agglomeration thereof is removed, i.e., in the state of substantially primary particles. Herein, "strong agglomeration" means a state wherein the agglomerates (having a particle size of about 10 μm or more) of the hardly water-soluble inorganic fine powder such as colloidal silica are contained in the aqueous dispersion medium in an amount of 70 wt. % or more based on the total weight of the fine powder. Further, "state of substantially primary particles" means a state wherein the above-mentioned agglomerates are contained in an amount of 1 wt. % or less, e.g., on the basis of their dissociation. In this case, the mode particle size of the hardly water-soluble inorganic fine powder contained in the aqueous dispersion medium is assumed to be 0.1 μm or less.

Then, the dispersant is subjected to coexistence with the above-mentioned compound derived from a coupling agent. In this case, it is assumed that the dispersant particles are more stable in an association state wherein the particles are loosely agglomerated than in a state of individual fine particles, because of the interaction between the dispersant particles and the above-mentioned compound. The thus prepared dispersant particles in the aqueous dispersion medium, which is in the association state, have relatively uniform particle sizes, and the repulsion between the mutual associated particles is suppressed at a relatively low level. As a result, the covering of the droplets (polymerizable monomer composition particles) with these dispersant particles becomes more uniform and strong whereby not only the effect of stabilizing the droplets may be enhanced but also a phenomenon such as the coalescence of the droplets based on the change in droplet viscosity may be suppressed in the polymerization step.

The effect obtained in the above-mentioned association state is extremely difficult to be obtained in a strong agglomeration state which hardly water-soluble inorganic fine powder previously surface-treated assumes. For example, when hardly water-soluble inorganic fine powder which has previously been surface-treated with a treating agent such as silane coupling agent, is dispersed in an aqueous dispersion medium, the agglomerates having a particle size of about 10 μm or more are generally contained in an amount of 30 wt. % or more.

The particle sizes of the inorganic fine powder assuming such strong agglomeration state are generally uneven, and such particle size can be larger than that of the polymerizable monomer composition particle (droplet) to be stabilized. Therefore, it has been difficult to uniformly cover the droples with the inorganic fine powder assuming the strong agglomeration state, and further improvement has been required in order to uniformly cover the droplets and to prevent the coalescence thereof.

Conventionally, fine powder used for a dispersant has been surface-treated in its powdery form. In order to obtain a dispersant which is uniformly surface-treated, it is necessary to carefully control stirring conditions under such treatment and conditions of adding a treating agent such as silane coupling agent. Therefore, this has been an obstacle to the production of surface-treated dispersant.

In the conventional process, because the powdery dispersant has been stirred under the above-mentioned treatment, there has been an operational problem of scattering of the fine powder. Further, there has been a problem of scattering or evaporation of the treating agent. As a result, it is difficult to effectively use the expensive treating ggent and therefore the production cost is caused to increase.

Furthermore, in the conventional process, it is sometimes required to particularly pretreat the dispersant which has previously been surface-treated, in order to enhance the wettability and dispersibility thereof to an aquoeus dispersion medium. In this case, the production cost is further increased.

These and other objects, features and advantages of the present invention will become more apparent upon a consideration of the following description of the preferred embodiments of the present invention taken in conjunction with the accompanying drawing. In the following description, "%" and "parts" representing quantity ratios are by weight unless otherwise noted specifically.

BRIEF DESCRIPTION OF THE DRAWING

The sole FIGURE in the attached drawing is a sectional view schematically showing a developing apparatus used in Examples of the present invention described hereinafter.

DETAILED DESCRIPTION OF THE INVENTION

In the process of the present invention, hydrophilic hardly water-soluble inorganic fine powder and a specific coupling agent are contained in an aqueous dispersion medium such as water, whereby the inorganic fine powder is caused to assume a desirable dispersion state (i.e., an association state). Into the aqueous dispersion medium containing the inorganic fine powder in the association state, a polymerizable monomer composition comprising a polymerizable monomer such as styrene, a colorant such as carbon black, and a polymerization initiator is charged, dispersed into particles, and subjected to suspension polymerization.

In the granulation step and the polymerization step of the process according to the present invention, fine powder dispersant (hardly water-soluble inorganic fine powder) having a sharp particle size distribution and improved ability to stabilize polymerizable monomer composition particles is present at the surfaces thereof to selectively stabilize the polymerizable monomer composition particles having a desired particle size, whereby polymerization toner particles having a sharp particle size distribution are obtained.

Hereinbelow, there is described a preferred method of preparing the hardly water-soluble inorganic fine powder in the above-mentioned desirable association state.

(1) Hydrophilic hardly water-soluble inorganic fine powder is sufficiently dispersed in an aqueous medium so that the agglomerates having a particle size of 10 μm or larger are contained in an amount of 1 wt. % or less based on the total weight of the inorganic fine powder. Thereafter, a coupling agent either in itself or in a state diluted with water or water-soluble (or water-miscible) solvent, is added to the resultant mixture.

In this case, it is possible to add the coupling agent (and/or the hydrolysis product thereof) either under stirring with a dispersing device or in a quiescent state, but it is preferred to effect the addition under stirring in order to obtain a uniform dispersion state. Further, the coupling agent may be added either at normal temperature (or room temperature) or on heating, but it is preferred, in view of the process, to hydrolyze the coupling agent while heating up to a temperature almost the same as a polymerization temperature.

(2) A coupling agent is dissolved or dispersed in an aqueous medium, and thereafter hardly water-soluble inorganic fine powder either in itself or in a state wherein it has been dispersed in water in advance, is added to the resultant mixture.

In this case, it is possible to add the coupling agent either under stirring with a dispersing device or in a quiescent state, but it is preferred to effect the addition under stirring in order to obtain a uniform dispersion state.

(3) Further, it is possible to form hardly water-soluble inorganic fine powder (such as $CaSO_4$) in water by using substances such as sodium sulfate and calcium chloride and to treat the resultant dispersion in a manner as described in the above-mentioned method (1) or (2).

In the above-mentioned method (1), (2) or (3), the aqueous medium is water per se or a mixture system comprising water and a water-soluble solvent. In this mixture system, the water-soluble solvent is mixed with wate in an amount smaller than that of the water.

In the present invention, it may be preferably determined on the basis of a particle size distribution measured by means of a Coulter counter whether the hardly water-soluble inorganic fine powder has been uniformly treated without forming strong agglomerates.

More specifically, the particle size distribution may be measured in the following manner. Thus, a sample (e.g., hardly water-soluble inorganic fine powder to which a coupling agent has been added) is added to a 1% salt solution at a concentration of about 10%, and dispersed by using ultrasonic vibration (36 KHz, 100 W, 1 min.) in an ordinary manner. Thereafter, the sample may be measured by using a Coulter counter with a 100 μm-aperture (or orifice) thereby to determine a particle size distribution.

In the present invention, the thus measured particle size distribution by number of particles may preferably be such that the particles having a particle size of 5.04 μm or larger is present in an amount of 5% by number or less. Further, the particle size distribution may more preferably be such that the particles having a particle size of 3.17 μm or larger is present in an amount of 5% by number or less.

As the hardly water-soluble inorganic fine powder used in the present invention, it is possible to use inorganic fine powder which is substantially insoluble in water at normal temperature.

Specific examples of inorganic fine powder may include: hardly water-soluble salts such as $BaCO_3$, $CaCO_3$ and $Ca_3(PO_4)_2$; inorganic macromolecules such as colloidal silica, $Al_2O_3$ and $TiO_2$; and powder of metal oxides. Among these, there may be particularly preferably used fine powder of metal oxides such as colloidal silica, aluminum oxide ($Al_2O_3$) and titanium oxide ($TiO_2$), in combination with a specific coupling agent in an aqueous dispersion medium.

The particle size of the hardly water-soluble inorganic fine powder may preferably be 1 μm or smaller, more preferably 0.5 μm or smaller, in terms of a primary particle size (i.e., the particle size of a primary particle).

In a case where silica fine powder is used as the hydrophilic hardly water-soluble inorganic fine powder, the following silica may be used.

Aerosil #130, #200, #300, #380, Mox 80, Mox 70 and COK 84 (mfd. by Nihon Aerosil K.K.);

Nipsil E, Nipsil E200A, Nipsil E220A, Nipsil LP, Nipsil NS-T, and Nipsil N300A (mfd. by Nihon Silica K.K.); and Finesil T-32 (mfd. by Tokuyama Soda K.K.).

On the other hand, in a case where aluminum oxide is used as hydrophilic hardly water-soluble inorganic fine powder, Aluminum Oxide C (mfd. by Nihon Aerosil K.K.) may be used. Further, in a case where titanium oxide is used, Titanium Oxide P25 (mfd. by Nihon Aerosil K.K.) may be used.

In the present invention, as the coupling agent, one which is soluble in an aqueous medium (such as water) and hydrolyzed in the aqueous medium may preferably be used. The hydrolysis product of the coupling agent is absorbed, on the basis of a bond such as a hydrogen bond, on the surfaces of the hardly water-soluble inorganic fine powder which coexists therewith in the aqueous dispersion medium. As a result, the hardly water-soluble inorganic fine powder is supplied with characteristics such that it has been surface-treated with a coupling agent such as silane coupling agent.

Specific examples of the coupling agent may include the following compounds (1) and (2).

(1) Compounds capable of coupling with hardly water-soluble inorganic fine powder to impart hydrophobicity thereto:

Herein, as the compound imparting hydrophobicity, one providing the following contact angle (or angle of contact) may preferably be used: a contact angle ($\theta_1$) between water and inorganic fine powder after being treated with a coupling agent in dry process, and a contact angle ($\theta_2$) between water and the inorganic fine powder before such treatment preferably satisfy the relationship $\theta_1/\theta_2>1$, more preferably $\theta_1/\theta_2\geqq 2$. The above contact angle may be measured, e.g., by using "pellet method" as described in Shikizai (Coloring Material), 57 (7), 363–372 (1984). Further, in the above-mentioned dry process treatment, the coupling agent may preferably be used in an amount of 0.1–20 parts (more preferably 0.2–10 parts), per 100 parts of the hardly water-soluble inorganic fine powder.

More specffically, there may be used: silane coupling agents having an alkoxy group as a hydrolyzable group such as γ-mercaptopropyltrimethoxysilane, methyltrimethoxysilane, methyltriethoxysilane, vinyltriacetoxysilane, γ-chloropropyltrimethoxysilane, vinyltrimethoxysilane, γ-chloropropylmethyldimethoxysilane, γ-mercaptopropylmethyldimethoxysilane;

titanate-type coupling agents such as isopropyltriisostearoyltitanate, isopropyltridecylbenzenesulfonyltitanate, isopropyltris(dioctylpyrophosphate)titanate, bis(dioctylpyrophosphate)oxyacetatetitanate, bis(dioctylpyrophosphate)ethylene-titanate, isopropyltrioctanoyltitanate, isopropyldimethacrylisostearoyltitanate, isopropyltri(dioctylphosphate)titanate, isopropyltricumylphenyltitanate, dicumylphenyloxyacetatetitanate and diisostearoylethylenetitanate; and aluminum- or aluminate-type coupling agents such as acetoalkoxyaluminum diisopropylate. (2) Compounds which is capable of attaching to or coupling with the surface of the hardly water-soluble inorganic fine powder and has at least one functional group selected from-amino, hydroxy, carboxy, and epoxy groups:

More specifically, there may be used coupling agents having at least one of these functional group, such as silane coupling agent, titanate coupling agent, aluminum-type coupling agent and zircoaluminate-type ooupling agent.

Specific examples of these coupling agents may include:

silane coupling agents including a nitrogen-containing silane coupling agent having an alkoxy group, such as γ-(2-aminoethyl)aminopropyltrimethoxysilane, γ-(2-aminoethyl)aminopropylmethyldimethoxysilane, octadecyldimethyl[3-(trimethoxysilyl)propyl]-ammonium chloride, and γ-aminopropyltriethoxysilane;

glycidoxy silane coupling agents having an alkoxy group such as γ-glycidoxypropyltrimethoxysilane;

titanate-type coupling agents such as isopropyltridecylbenzenesulfonyltitanate, isopropyltris(dioctylpyrophosphate)titanate, tetraisopropyl(dioctylphosphite)titanate, tetraoctylbis(ditridecylphosphite)titanate, tetra(2,2-diallyloxymethyl-1-butyl)-bis(ditridecyl)-phosphitetitanate, bis(dioctylpyrophosphate)oxyacetatetitanate, bis(dioctylpyrophosphate)ethylenetitanate, and isopropyltri(N-aminoethyl-aminoethyl)titanate; and zircoaluminate-type coupling agents including those commercially available product (e.g., those sold under the trade name of CAVCO MOD available from Cavedon Chemical Co. Inc., U.S.A.) such as Cavco Mod-A (amino group-containing compound), Cavco Mod-C (carboxyl group-containing compound), Cavco Mod-C-1 (carboxyl group-containing compound), Cavco Mod-APG (amino group-containing compound), Cavco Mod-CPG (carboxyl group-containing compound), and Cavco Mod-CPM (carboxyl group-containing compound).

In the present invention, it is possible to use these coupling agents which is, with respect to an aqueous dispersion medium, emulsion-type, dispersion-type, or dissolution-type. However, those soluble in water may preferably be used in order to simplify the process.

Further, in order to enhance the solubility of the coupling agent, it may be formed into a water-soluble adduct salt with an amine. Further, the pH value of the aqueous dispersion medium may be adjusted in order to enhance the solubility of the coupling agent.

In the present invention, among above-mentioned coupling agents, silane coupling agents and zircoaluminate coupling agents may preferably be used in view of good solubility thereof in water.

Further, the above coupling agents may preferably be added to an aqueous dispersion medium in an amount of 0.1–20 parts (more preferably 0.2 10 parts), per 100 parts of the hardly water-soluble inorganic fine powder. If the coupling agents of below 0.1 part is used, the effect of the treatment is a little. On the other hand, the coupling agent of above 20 parts is used, the wettability of the inorganic fine powder undesirably decreases.

In the present invention, the coupling agent may be used singly or as a combination of two or more species. In the latter case, these coupling agents may belong to the same group of the above-mentioned group (1) or (2), or to the different groups of group (1) and (2).

Preferred combination of the hardly water-soluble inorganic fine powder and the coupling agent used in the present invention are exemplified hereinbelow. Herein, the inorganic fine powder may preferably have a solubility of 100 mg or less, more preferably 50 mg or less, in 100 g of water.

Colloidal silica may preferably be used in combination with a silane coupling agent, a titanate-type coupling agent, or a zircoaluminate-type coupling agent, particularly in combination with a silane coupling agent having an alkoxy group.

The hardly water-soluble salt, which preferably has a solubility of 100 mg or less, more preferably 50 mg or less in 100 g of water, may preferably be used in combination with a titanate-type coupling agent, or a zircoaluminate-type coupling agent.

Further, powder of inorganic macromolecule or metal oxide may preferably be used in combination with a silane coupling agent, a titanate-type coupling agent, or a zircoaluminate-type coupling agent, more preferably in combination with a silane coupling agent and a zircoaluminate coupling agent.

As described hereinabove, when the hardly water-soluble inorganic fine powder is, in its powdery form, treated with a coupling agent in dry process in advance, many large agglomerates thereof are sometimes formed, or the hydrophobicity of the fine powder sometimes becomes too high whereby the fine powder cannot be dispersed in an aqueous dispersion medium satisfactorily. Similarly, when the coupling agent is dissolved in an organic solvent to prepare a dilute solution of the coupling agent and then hardly water-soluble inorganic fine powder is surface-treated with the dilute solution, a similar phenomenon is liable to occur.

On the contrary, in the present invention, a coupling agent is added into an aqueous dispersion medium and hydrolyzed therein toy yield a decomposition product which is then absorbed to the surfaces of hardly water-soluble inorganic fine powder dispersed in the aqueous dispersion medium. Therefore, in the present invention, there can be used the above-mentioned coupling agent capable of imparting high hydrophobicity, which has heretofore been difficult to be used. Hereinbelow, there is schematically described an embodiment wherein silica fine powder is used as the hardly water-soluble inorganic fine powder and γ-aminopropyltriethoxysilane is used as the coupling agent. Incidentally, in the following scheme, a symbol " " denotes a hydrogen bond.

Present Invention

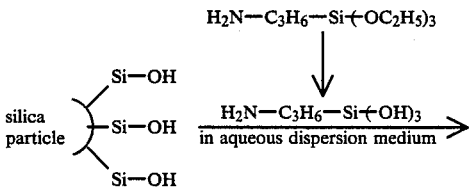

-continued

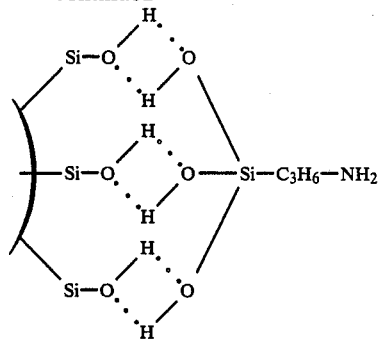

(hydrogen bond)

Prior Art (i) Pretreatment Step

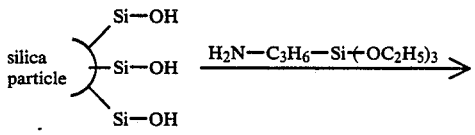

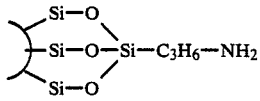

(treated silica)

(ii) Dispersion Step

The silica pretreated with γ-aminopropylsilane is added to an aqueous dispersion medium.

As described above, according to the present invention, even in a case where there is used such a coupling agent that it cannot provide uniform dispersibility of inorganic fine powder in water when the powder is treated therewith in its powdery form in dry process, the inorganic fine powder may be dispersed in an aqueous dispersion medium in a good association state. This point is very important in view of the improvement in stability which is based on the uniform covering of the surfaces of monomer composition particles (droplets). As a result, in the present invention, there can be used a dispersant which has heretofore been abandoned because it has high hydoophobicity and is difficult to be uniformly dispersed in water while it has been supposed to be able to provide more effective covering of the droplet surfaces.

Further, in the present invention, a dispersant (hardly water-soluble inorganic fine powder) may be removed extremely easily by washing with an aqueous alkaline or acidic solution, whereby the developing characteristic of the resultant polymerization toner are considerably enhanced. Furthermore, the amount of such alkali or acid may be reduced. Particularly, under high temperature-high humidity conditions, the thus prepared toner according to the present invention may exhibit considerably excellent developing characteristics. The reason for such effect is assumed to be that the dispersant is readily and sufficiently dissolved in the aqueous alkaline or acidic solution because there is substantially no strong agglomerate of the dispersant in the aqueous dispersion medium, an the bond between the dispersant and the hydrolysis product from the coupling agent is weak.

In the present invention, the hardly water-soluble inorganic fine powder may be separated from the polymerization toner surface in the following manner.

Thus, an alkali may be directly added to the aqueous dispersion medium containing a polymerization toner after suspension polymerization to make the aqueous dispersion medium per se alkaline, whereby the hardly water-soluble inorganic fine powder is dissolved. Thereafter, the polymerization toner may be separated from the aqueous dispersion medium.

Alternatively, a polymerization toner may be separated from an aqueous dispersion medium after suspension polymerization, and then the polymerization toner is added to an aqueous alkaline solution such as aqueous sodium hydroxide solution whereby the inorganic fine powder present at the surface of the polymerization toner is dissolved. Then, the polymerization toner may be separated from the alkaline solution.

In order to simplify the process, it is preferred to directly add a strong alkali compound or strong acid to the aqueous dispersion medium.

The amount of the alkali compound or strong acid used may preferably be at least 1 equivalent and below 3.5 equivalent, per 1 equivalent of the hardly water-soluble inorganic fine powder. More specifically, in case where silica ($SiO_2$) fine powder is used as hhe inorganic fine powder and sodium hydroxide (NaOH) is used as the alkali compound, it is preferred that the sodium hydroxide is used in an amount of 0.62 wt. part (about 0.022 mol. part) to 1.83 wt. part (about 0.033 mol. part), per 1 wt. part (about 0.021 mol. part) of silica fine powder. In consideration of the period of time for dissolving the silica and the influence on the polymerization toner, it is further preferred that 0.9 wt. part to 1.6 wt. parts of the sodium hydroxide are used per 1 wt. part of the silica fine powder.

In the present invention, the aqueous dispersion medium may be prepared in the following manner.

Thus, hydrophilic hardly water-soluble inorganic fine powder is added to water, and is uniformly dispersed under stirring so that the inorganic fine powder is substantially in the form of fine particles or fine agglomerates having a particle size of 0.1 μm or smaller. As the stirring means, a high shearing force mixer such as a homomixer having a turbine rotatable at a high speed and a stator, or homogenizer may preferably be used. When the peripheral speed of the turbiee is 10–30 m/sec, the stirring may preferably be conducted for 5–60 min. in order to dissociate the agglomerate of the inorganic fine powder. Then, a coupling agent or an aqueous solution thereof is added to the aqueous dispersion medium wherein the inorganic fine powder is dispersed, and the resultant mixture is further stirred.

The stirring may preferably be conducted for 5–60 min. It is preferred that the coupling agent is added, the resultant mixture is stirred, and thereafter the hydrolysis reaction is promoted by heating.

In the granulation step of the present invention a high shearing force mixer (or stirrer) such as a homomixer having a turbine rotatable at a high speed and a stator, or homogenizer may preferably be used as a means for granulating the polymerizable monomer composition in the aqueous dispersion medium. It is generally preferred to control the stirring speed or stirring time so that he polymerizable monomer composition particles have a particle size of 30 μm or smaller. The speed of rotation may preferably be controlled so that the peripheral speed of the turbine becomes 10–30 m/sec. The granulation time may preferably be 5–60 min. while it is not particularly limited.

The liquid temperature in the granulation step may be adjusted to such a temperature as to provide a viscosity of 1–1,000,000 cps, preferably 10–100,000 cps, more preferably 10–10,000 cps, of the monomer composition, so that the resultant monomer composition particles have a particle size of 1–10 μm which provides a weight-average particle size of 1–10 μm of a toner for developing. As the aqueous dispersion medium, water or an aqueous medium consisting predominantly of water is generally used, so that the temperature of the dispersion medium may preferably be set to 20°–80° C., particularly 40°–70° C.

In the dispersion, the aqueous dispersion medium may preferably be present in an amount of 200–1000 wt. parts per 100 wt. parts of the polymerizable monomer composition; and the fine powdery disperson stabilizer (hardly water-soluble inorganic fine powder) may preferably be uscd in a amount of 1–20 wt. %, further preferably 3–10 wt. %, based on the polymerizable monomer composition.

Hereinbelow, the respective components constituting the polymerizable monomer composition will be described.

The polymerizable monomer applicable to the present invention may be those having a vinyl group ($CH_2{=}C<$). Examples thereof include: styrene and its derivatives such as styrene, o-methylstyrene, m-methylstyrene, p-methylsytrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylene or monoolefins such as ethylene, propylene, butylene, and isobutylene; vinyl halides suc as vinyl chloride, vinylidene chloride, vinyl bromide and vinyl fluoride; vinyl esters such as vinyl acetate, vinyl propionate, and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; maleic acid and maleic acid half esters; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; derivatives of acrylic acid and methacrylic acids such as acrylonitrile, methacrylonitrile, and acrylamide. These monomers may be used either signly or in mixture of two or more species. Among these, it is preferred to use styrene or its derivative alone or in combination with another monomer in view of the developing characteristics and durability of the resultant toner. More specifically, it is particularly preferred to use styrene in combination with an alkyl ($C_1$–$C_{18}$) acrylate, an alkyl ($C_1$–$C_{18}$) methacrylate or an alkyl ($C_1$–$C_{10}$) maleate.

In the monomer composition, it is preferred to incorporate a low-softening point (preferably 50°–130° C.) compound having a releasing characteristic including waxes such as paraffin wax; and low-molecular weight polyolefins such as low-molecular weight polyethylene and low-molecular weight polypropylene in order to improve the fixability and anti-offset chrracteristic in the hot-roller fixation. In this case, the amount of addition thereof may be 1–300 wt. parts per 100 wt. parts of the polymerizable monomer.

Examples of the low-softening point compound include paraffins, waxes, low-molecular weight polyolefins, modified waxes having aromatic group, natural waxes, long-chain carboxylic acids having a long hydrocarbon chain ($CH_3$—$CH_2)_{11}$ or —$CH_2)_{12}$ or longer aliphatic chains) including 12 or more carbon atoms, and esters thereof. Different low-softening point compounds can be mixed. Examples of commercially available products include Paraffin Wax (Nihon Sekiyu K.K.), Paraffin Wax (Nihon Seiro K.K.), Microwax (Nihon Sekiyu K.K.), Microcrystalline Wax (Nihon Seiro K. , Hard Paraffin Wax (Nihon Seiro K.K.), PE-130 (Hoechst), Mitsui Hi-Wax 110P (Mitsui Sekiyu Kagaku K.K.), Mitsui Hi-Wax 220P (ditto), Mitsui Hi-Wax 660P (ditto), Mitsui Hi-Wax 210P (ditto), Mitsui Hi-Wax 320P (ditto), Mitsui Hi-Wax 410P (ditto), Mitsui Hi-Wax 420P (ditto), Modified Wax JC-1141 (ditto), Modified Wax JC-2130 (ditto), Modified Wax JC-4020 (ditto), Modified Wax JC-1142 (ditto), Modified Wax JC-5020 (ditto); bees wax, carnauba wax, and montan wax.

In the polymerizable monomer composition, it is also possible to incorporate a crosslinking agent as exemplifeed below in order to produce a crosslinked polymer. Particularly, when no polymer, copolymer or cyclized rubber is added into the monomer composition, it is preferred to add a crosslinking agent in the monomer composition.

Examples of the crosslinking agent may appropriately include: divinylbenzene, divinylnaphthalane, polyethylene glycol dimethacrylate, diethylene glycol diacrylate, triethylene glycol diacrylate, 1,3-butylene glycol dimethacrylate, 1,6-hexane glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. These crosslinking agents may be used either signly or in a mixture of two or more species, as desired.

If such a crosslinking agent is used in an excessive amount, the resultant toner particles lose fusibility to show a poor fixability in heat-fixing or heat and pressure fixing. If the amount of the crosslinking agent is too small, properties such as anti-offset characteristic, anti-blocking characteristic and durability become poor, so that it becomes difficult to prevent the offset phenomenon that, in hot-press roller fixation, a portion of a toner is not completely fixed onto paper but fixed onto a roller surface, and is then re-transferred onto a subsequent sheet of paper. For these reasons, the amount of use of the crosslinking agent may suitably be 0.001–15 wt. %, preferably 0.1–10 wt. %, of the polymerizable monomer.

The polymerizable monomer composition generally contains a colorant. The colorant may comprise known dyes or pigments such as carbon black or grafted carbon black obtained by coating the surface of carbon black with a resin. These colorants may be used either signly or in a mixture of two or more species, as desired. The colorant may be contained in a proportion of 0.1–30 wt. % based on the amount of the polymerizable monomer.

It is possible to add a charge controller or a fluidity improver as desired into the toner (internal addition). In a case where the charge controller is internally added, it may generally be added into the polymerizable monomer composition. Such a charge controller or a fluidity improver can also be mixed with the toner particles (external addition). The charge controller may for example be a metal complex of an organic compound having a carboxyl group or a nitrogen-containing group, a metal-containing dye, or a nigrosine. The fluidity improver or a cleaning aid for the surface of a latent image-bearing member (photosensitive member) may for example be colloidal silica or an aliphatic acid metal salt. Further, it is possible to add a fluidity improver such as polytetrafluoroethylene fine powder or zinc stearate powder in order to disintegrate the agglomerate of the toner particles and improve the fluidity.

In order to produce a magnetic polymerization toner, magnetic particles are added into the polymerizable monomer composition. In this case, the magnetic particles also function as a colorant partially or entirely. The magnetic particles usable in the present invention may be a substance magnetizable when placed in a magnetic field, such as powder of a ferromagnetic metal such as iron, cobalt and nickel, an alloy thereof, or compound thereof such as magnetite, hematite and ferrite. The magnetic particles may have a particle size of 0.05–5$\mu$, preferably 0.1–1$\mu$. In order to produce a small particle size (8$\mu$ or smaller) toner, it is preferred to use magnetic particles of 0.8$\mu$ or smaller. The content of the magnetic particles may suitably be 10–100 parts, preferably 10–60 parts, more preferably 20–50 parts, in 100 parts of the monomer composition. It is possible that the magnetic particles have been treated with a treating agent such as silane coupling agent or titanate coupling agent or with an appropriate reactive resin. In this case, while also depending on the surface area of the magnetic particles or the density of the hydroxyl group present at the surface thereof, a treating amount of 5 parts or less, preferably 0.1–3 parts, per 100 parts of the magnetic particles may provide a sufficient dispersibility in the polymerizable monomer whereby a bad influence is not exerted on the toner properties. It is also possible to use a mixture of lipophilic magnetic particles and hydrophilic magnetic particles.

According to our knowledge, when a water-soluble initiator is used, the resultant polymerization toner is caused to have a low moisture resistance, and suffers from degradation in developing characteristic and anti-blocking property under high temperature-high humidity conditions. For this reason, in order to produce a polymerization toner with excellent environmental characteristics, it is preferred to use a substantially water-insoluble polymerization initiator. More specifically, the substantially water-insoluble polymerization initiator preferably used in the present invention has a solubility of 1 g or less in 100 g of water, preferably 0.5 g or less in 100 g of water, particularly preferably 0.2 g or less in 100 g of water, respectively at room temperature. When the solubility is more than 1 g in 100 g of water, the decomposition product of the initiator remaining on the surfaces of the polymerization toner particles undesirably lowers the moisture resistance of the polymerization toner. The polymerization initiator preferably used in the present invention is soluble in the polymerizable monomer and has a property of being well dissolved in the monomer in an ordinarily used range of amount (1–10 wt. parts per 100 wt. parts of the monomer). Examples of the polymerization initiator usable in the present invention may include: azo- or diazo-type polymerization initiators such as 2,2'-azobis( 2,4-dimethylvaleronitrile), 2,2'-azobisisobutylonitrile (AIBN), 1,1'-azobis(cyclohexane-1-carbonitrile), 2,2'-azobis-4-methoxy-2,4-dimethylvaleronitrile, etc.; and peroxide-type polymerization initiators such as benzoyl peroxide, methyl ethyl ketone peroxide, isopropyl peroxycarbonate, cumene hydroperoxide, 2,4-dichlorobenzoyl peroxide and lauroyl peroxide. In the production process of the present invention, it is preferred to use two or more polymerization initiators in mixture in order to control the molecular weight and molecular weight distribution of the resultant polymer or in order to control the reaction time.

The amount of use of the polymerization initiator may be in the range of 0.1–20 wt. parts, preferably 1–10 wt. parts, per 100 wt. parts of the polymerizable monomer. Below 0.1 wt. part, it is difficult to distribute or provide the initiator evenly to individual monomer composition particles. Above 20 wt. parts is excessive to provide too low a molecular weight of the polymerization product and to increase the tendency that the polymerization occurs ununiformly. It is preferred to add such polymerization initiator to the polymerizable monomer composition before granulation in order to distribute or provide the initiator evenly to individual monomer composition particles, while it is possible to add the initiator to the dispersion system comprising the monomer composition particles after granulation.

The suspension polymerization is generally carried out at a polymerization temperature of 50° C. or higher, and the upper limit temperature may be set in consideration of the decomposition speed of the polymerization initiator. Too high a polymerization temperature is not desirable because the polymerization initiator is decomposed too rapidly.

After it has been confirmed that the resultant particles of the polymerizable monomer composition have a prescribed particle size, the temperature of the aqueous dispersion medium containing the particles is adjusted to a polymerization temperature (e.g. 55°–70° C.), thereby to cause suspension polymerization.

If a compound having a polar group, which is soluble in the polymerizable monomer to be used, such as a polar polymer (inclusive of copolymer) or cyclized rubber is further added to a polymerizable monomer composition to be polymerized, a preferable polymerization toner having a pseudo-capsule structure can be obtained. The polar polymer or cyclic rubber may preferably be added in an amount of 0.5–50 wt. parts, preferably 1–40 wt. parts, per 100 wt. parts of the polymerizable monomer. Below 0.5 wt. part, it is difficult to obtain a desired pseudo-capsule structure. Above 50 wt. parts, there arises an increased tendency that the characteristics of the polymerization toner are lowered because the amount of the polymerizable monomer becomes insufficient. It is preferred that a polymerizable monomer composition containing the polar polymer or cyclized rubber thus added is suspended in an aqueous medium containing a fine powdery dispersant dispersed therein.

The cationic polymer (inclusive of copolymer), anionic polymer (inclusive of copolymer) or anionic cyclized rubber thus contained in the polymerizable monomer composition exerts an electrostatic force at the surface of toner-forming particles with the anionic or cationic dispersant dispersed in the aqueous medium, so that the dispersant covers the surface of the particles to prevent coalescence of the particles with each other and to stabilize the dispersion. In addition, as the added polar polymer or cyclized rubber gathers at the surface layer of the particles, a sort of shell is formed to provide the particles with a pseudo-capsule structure. The polar polymer or cyclized rubber of a relatively large molecular weight thus gathered at the particle surfaces provides the polymerization toner particles of the present invention with excellent anti-blocking characteristic, developing characteristic, charge-controlling characteristics and abrasion resistance.

Examples of the polar compound (inclusive of polymer, copolymer and cyclized rubber) usable in the present invention may be raised hereinbelow. The polar compound having a weight-average molecular weight of 5,000–500,000 as measured by GPC (gel permeation chromatography) is preferred because of good solubility in the polymerizable monomer and characteristic of providing a durable toner.

(a) Cationic polymers: polymers of nitrogen-containing monomers such as dimethylaminoethyl methacrylate and diethylaminoethyl acrylate; copolymers of styrene an such a nitrogen-containing monomer; and a copolymer of styrene or an unsaturated carboxylic acid ester and such a nitrogen-containing monomer.

(b) Anionic polymers: polymers or copolymers of anionic monomers inclusive of nitrile monomers such as acrylonitrile, halogen-containing monomers such as vinyl chloride, unsaturated carboxylic acid such as acrylic acid, unsaturated dibasic acids, and unsaturated dibasic acid anhydrides; and copolymers of styrene and such as anionic monomer. Cyclized rubber may also be used as an anionic polymer.

In the production process according to the present invention, it is preferred that the hardly water-soluble inorganic fine powder per se or the coupling agent has a chargeability to a polarity opposite to that of the polymerizable monomer composition in the liquid dispersion medium.

It is possible to further add an appropriate dispersion stabilizer in the aqueous dispersion medium. Examples of such a dispersion stabilizer include polyvinyl alcohol, gelatin, methyl cellulose, methyl hydropropyl cellulose, ethyl cellulose, sodium carboxymethyl cellulose, polyacrylic acid and salts thereof, starch, gum alginic acid salts, zein, casein. One or more of these compounds may be added to the aqueous dispersion medium to such an extent that the process of the present invention is not adversely affected thereby.

In order to effect uniform dispersion of the inorganic dispersion stabilizer, it is possible to add a surfactant within an extent of not adversely affecting the process of the present invention. The surfactantiis used to promote the above-mentioned dispersion stabilizer to show the prescribed function. Specific examples of such a surfactant include: sodium dodecylbenzenesulfonate, sodium tetradecylsulfate, sodium pentadecylsulfate, sodium octylsulfate, sodium allyl-alkyl-polyethersulfonate, sodium oleate, sodium laurate, sodium caprate, sodium caprylate, sodium caproate, potassium stearate, calcium oleate, sodium 3,3-disulfonediphenylurea-4,4-diazo-bis-amino-8-naphthol-6-sulfonate, ortho-carboxybenzene-azodimethylaniline, sodium 2,2,5,5-tetramethyltriphenylmethane- 4,4-diazo-bis-β-naphthol-disulfonate, and others. It should be noted that the moisture resistance of the polymerization toner can be lowered when a hydrophilic organic stabilizer or surfactant is used.

It is also possible to add a Broensted acid such as hydrochloric acid to an aqueous medium in order to enhance the ionization of the polar group of the polar compound in the monoeer composition. Particularly, when silica fine powder is used as the hardly water-soluble inorganic fine powder and a nitrogen-containing silane coupling agent having an alkoxy group is used, the addition of a Broensted acid such as hydrochloric acid in the aqueous dispersion medium is effective in enhancing the effect of an anionic polymer (including copolymer) or cyclized rubber.

After the completion of the polymerization of the polymerizable monomer composition, the resultant reaction product may be aftertreated thereby to obtain polymerization toner particles. For example, the powdery dispersion stabilizer attached to the surfaces of the produced toner particles may be removed by dissolution or by washing, and then the toner particles may be recovered by an appropriate method such as filtration, decantation and centrifugation, and dried, thereby to obtain a polymerization toner.

The polymerization toner according to the present invention is applicable to the known dry system methods for developing electrostatic images including the two-component developing methods such as the cascade method, the magnetic brush method, the microtoning method and the two-component AC bias developing method; the one-component developing methods using a magnetic toner such as the electroconductive one-component developing method, the insulating one-component developing method and the jumping developing method; the powder cloud method and the fur brush method; the nonmagnetic one-component developing method wherein the toner is carried on a toner-carrying member to be conveyed to a developing position and subjected to development thereat; and the electric field curtain method wherein the toner is conveyed by an electric field curtain to a developing position and subjected to development thereat. Thus, the process of the present invention is especially suitably applicable to the production process for a small particle size toner having a weight-average particle size of about 2–8μ with a sharp particle size distribution.

As described above, according to the process of the present invention, polymerizable monomer composition particles are preferably formed by using hardly water-soluble inorganic fine powder coexisting with a coupling agent in an aqueous dispersion medium and by imparting the hydrolyzed coupling agent to the inorganic fine powder on the basis of a hydrogen bond, whereby a polymerization toner having a sharp particle size distribution and excellent developing characteristics is obtained in good yield.

Hereinbelow, the present invention will be described based on examples.

EXAMPLE 1

10 g of colloidal silica (#200, mfd. by Nihon Aerosil K.K.) as hardly water-soluble inorganic fine powder was charged to 1000 ml of ion-exchange water as an aqueous medium, and dispersed for 10 min. at 10,000 rpm (peripheral speed of about 13 m/sec) by means of a TK-homomixer (mfd. by Tokushu Kika Kogyo K.K.). Then, 0.3 g of γ-aminopropyltriethoxysilane, as a coupling agent, was diluted with 200 ml of ion-exchange water and the resultant mixture was then added to the aqueous medium prepared above, under stirring with the above-mentioned TK-homomixer. After the addition, the resultant mixture was stirred for 10 min., heated up to 60° C. and then further stirred for 10 min.

The particle size of the thus prepared colloidal silica in a dispersion state was measured by means of a Coulter counter. As a result, in the particle size distribution by number, the proportion of particles having a particle size of 3.17 μm or larger was 1% by number or less. Further, in the particle size distribution by volume, substantially no particle having a particle size of 10 μm or larger was contained.

To the thus prepared aqueous medium, 16 g or 1/10 N-HCl was added thereby to prepare an aqueous dispersion medium.

| | |
|---|---|
| Styrene monomer | 90 g |
| 2-Ethylhexyl methacrylate | 10 g |
| 2,2'-Azobis-(2,4-dimethylvaleronitrile) | 2 g |
| 2,2'-Azobisisobutyronitrile | 1 g |
| Cyclized rubber (Albex CK450, mfd. by Hoechst Japan, K. K.) | 15 g |
| Paraffin 155° F. (mfd. by Nihon Seiro K. K.) | 4 g |
| Charge-controlling organometal complex (Bontron E-81, mfd. by Orient Kagaku Kogyo K. K.) | 2 g |
| Crosslinking agent (NK-Ester 2G, mfd. by Shin-Nakamura Kagaku Kogyo K. K.) | 1 g |
| Carbon black (STERING R, mfd. by Cabot Co., U.S.A.) | 12 g |

The above ingredients were mixed at 60° C. by means of an attrittor to prepare a polymerizable monomer composition. The viscosity of the monomer composition at 60° C. was 300 cps. The thus obtained monomer composition was charged in a 2 l-stainless steel vessel which had already contained the aqueous dispersion medium prepared above, and the resultant mixture was stirred in a $N_2$-atmosphere at 60° C. for 30 minutes by means of a TK-homomixer (mfd. by Tokushu Kika Kogyo K.K.) rotating at 10,000 rpm (peripheral speed of about 13 m/sec) to granulate the monomer composition, thereby to prepare a liquid dispersion. The dispersion was then subjected to polymerization under stirring by means of a paddle stirrer for 10 hours at 60° C.

After the reaction system was cooled to room temperature, 14 g of sodium hydroxide was added to the aqueous dispersion medium thereof, and then stirred for 14 hours at room temperature to dissolve the colloidal silica in the aqueous dispersion medium.

Thereafter, the dispersion was subjected to filtration to separate toner particles from the aqueous dispersion medium. Then, the toner particles was washed with water, dehydrated, and dried to obtain a polymerization toner in 95% yield.

The resultant toner showed a volume-average particle size of 7.2μ (number-average particle size of 5.5μ), and contained 3% by volume of coarse particles with sizes over 10μ in a particle size distribution by volume according to the particle size measurement by means of a Coulter counter with an aperture of 100μ, thus showing a very narrow distribution.

15 grams of the resultant polymerization toner, 0.75 g of hydrophobic silica (Aerosil R972, mfd. by Nihon Aerosil K.K.) and 0.45 g of zinc stearate powder were mixed, and the resultant mixture was further mixed with 85 g of an insulating carrier (composed of magnetite and epoxy resin) having an average particle size of 50μ thereby to prepare a developer, which was then evaluated with respect to the electrophotographic characteristics in the following manner.

A developing apparatus as shown in the figure was used. An image-bearing member 1 has a selenium photosensitive member 11, which was rotated at a peripheral speed of 100 mm/sec, the maximum potential of an electrostatic image formed on the image bearing member 1 was +750 V. Opposite the image-bearing member 1 was disposed a sleeve 2 having an outer diameter of 20 mm and rotated at a peripheral speed of 100 mm/sec. A magnetic flux of 1000 Gauss was exerted to the surface of the sleeve (developer-carrying member) 2, in a direction perpendicular to the surface, with a magnet roller 3 having poles of $N_1$, $N_2$, $S_1$ and $S_2$. Thus, a layer of the developer in a thickness of 200 μm was formed. The sleeve 2 and the image bearing member 1 were disposed at gap of 300 μm. The bias voltage applied to the sleeve comprised a DC component of +200 V, and an AC component of 3.0 KHz and 1400 Vpp. The electrostatic image fommed on the image-bearing member was satisfactorily developed. The developed toner image was electrostatically transferred to plain paper, and satisfactorily fixed by passing through a hot roller fixing apparatus composed of a fixing roller surfaced with a silicone rubber layer and a pressure roller (nip width: 9 mm, paper moving speed of 300 mm/sec) under a pressure of 7 kg/cm$^2$ and at a fixing temperature (the temperature at the fixing roller surface) of 150° C. The resultant fixed image was free of fog and showed an image density (Dmax) of 1.44.

The above-mentioned development and fixation were also effected in the same manner under high temperature-high humidity conditions (32.5° C., 85% RH), whereby a fixed image showing an image density of 1.40 was obtained.

Incidentally, in the developing apparatus shown in the figure, a toner T mixed with an external additive (hydrophobic silica, etc.) was quantitatively supplied to a lower chamber by means of an elastic member 5 and a supply roller 4, and mixed with a carrier to form a developer 6. To the sleeve 2 having a magnet roller 3 therein and a doctor blade 7, a DC bias was supplied from a DC bias supply 8, and an AC bias was supplied from an AC bias supply 9. As the rotation of the sleeve 2 in the direction of A, the developer 6 was conveyed and supplied for development of an electrostatic latent image on the image-bearing member 1 comprising an aluminum cylinder 12 and the selenium photosensitive member 11. A developer regulating member 10 also functioned as an outer wall of the developing apparatus.

EXAMPLE 2

An aqueous dispersion medium was prepared and a dispersion containing a polymerizable monomer composition was subjected to polymerization in the same manner as in Example 1.

After the reaction system was cooled, the dispersion was subjected to filtration to separate toner particles from the aqueous dispersion medium. Then, the toner particles was added to 1000 ml of aqueous sodium hydroxide solution containing 14 g of NaOH, and then stirred for 15 hours at room temperature to dissolve the colloidal silica attached to the surfaces of the toner particles. The resultant dispersion was subjected to filtration to separate the toner particles from the aqueous sodium hydroxide solution. The toner particles was then washed with water, dehydrated, and dried to obtain a polymerization toner, in 95% yield.

The resultant toner showed a volume-average particle size of 7.2μ, and contained 3% by volume of coarse particles with sizes over 10μ according the particle size measurement by means of a Coulter counter with an aperture of 100μ, thus showing a very narrow distribution.

15 grams of the resultant polymerization toner, 0.75 g of hydrophobic silica (Aerosil R972, mfd. by Nihon Aerosil K.K.) and 0.45 g of zinc stearate powder were mixed, and the resultant mixture was further mixed with 85 g of an insulating carrier (composed of magnetite and epoxy resin) having an average particle size of 50μ, thereby to prepare a developer, which was then evaluated with respect to the electrophotographic characteristics in the same manner as in Example 1.

More specifically, an electrostatic image formed on an image bearing member was developed, and the developed toner image was electrostatically transferred to plain paper, and satisfactorily fixed by passing through a hot roller fixing apparatus composed of a fixing roller surfaced with a silicone rubber layer and a pressure roller (nip width: 9 mm, paper moving speed of 300 mm/sec) under a pressure of 7 kg/cm$^2$ and at a fixing temperature (the temperature at the fixing roller surface) of 150° C. The resultant fixed image was free of fog and showed an image density (Dmax) of 1.44.

EXAMPLE 3

| | |
|---|---|
| Styrene monomer | 180 g |
| 2-Ethylhexyl methacrylate | 20 g |
| 2,2'-Azobis-(2,4-dimethylvaleronitrile) | 8 g |
| 2,2'-Azobisisobutyronitrile | 1 g |
| Cyclized rubber (Albex CK450, mfd. by Hoechst Japan, K. K.) | 20 g |
| Paraffin 155° C. (mfd. by Nihon Seiro K. K.) | 16 g |
| Charge-controlling organometal complex (Bontron E-81, mfd. by Orient Kagaku Kogyo K. K.) | 4 g |
| Crosslinking agent (NK-Ester 2G, mfd. by Shin-Nakamura Kagaku Kogyo K. K.) | 2 g |
| Magnetic material* | 140 g |

*100 parts of magnetic material BL-200 (mfd. by Titan Kogyo K. K.) treated with 3 parts of titanate coupling agent.

The above ingredients were mixed at 60° C. by means of an attrittor to prepare a polymerizable monomer composition. The viscosity of the monomer composition at 60° C. was 600 cps. The thus obtained monomer composition was charged in a 2 l-stainless steel vessel which already contained the aqueous dispersion medium prepared in the same manner as in Example 1, by using colloidal silica and γ-aminopropyl triethoxysilane. The resultant mixture was stirred in a $N_2$-atmosphere at 60° C. for 30 minutes by means of a TK-homomixer (mfd. by Tokushu Kika Kogyo K.K.) rotating at 10,000 rpm to granulate the monomer composition, thereby to prepare a liquid dispersion. The dispersion was then subjected to polymerization under stirring by means of a paddle blade stirrer for 20 hours at 60° C.

The reaction product was cooled, dehydrated and washed with an aqueous sodium hydroxide solution, and further was washed with water, dehydrated, and dried to obtain a polymerization toner in 94% yield.

The resultant toner showed a volume-average particle size of 9.5μ (number-average particle size of 6.5μ), and contained 3% by volume of coarse particles with sizes over 16μ according to the particle size measurement by means of a Coulter counter with an aperture of 100μ, thus showing a very narrow distribution.

15 grams of the resultant polymerization toner, 0.6 g of hydrophobic silica (Tullanox-500, mfd. by Tulco Co., Ltd.) to prepare a developer.

The thus obtained developer was subjected to image formation (an image-forming test) by means of a copying machine NP-7550 (mfd. by Canon K.K.) under normal temperature-normal humidity (23° C., 60% RH) conditions, whereby an image excellent in image quality and image density was obtained.

Image formation was conducted in the same manner as described under high temperature-high humidity conditions (32.5° C., 90%), whereby an image excellent in image quality and image density was obtained.

COMPARATIVE EXAMPLE 1

100 g of colloidal silica (Aerosil #200) was charged to a Henschel mixer and stirred at a rotating speed corresponding to the scale-2 for 10 min. at 60° C., and then 3 g of γ-aminopropyltriethoxy silane was added thereto. After the addition, the powdery mixture was heated up to 100° C. under stirring with the Henschel mixer for 10 min. to effect heat treatment, and thereafter was heated up to 120° C. and further treated for 10 min.

The particle size of the thus treated colloidal silica was measured by means of a Coulter counter with an aperture of 100 μm. As a result, in the particle size distribution by volume, particles having a particle size of 10 μm or larger was contained in an amount of about 80 wt. %. Further, in a particle size distribution by number, the proportion of particles having a particle size of 5.04 μm or larger was 20% by number.

10.3 g of the thus treated colloidal silica was weighed and charged to 1200 ml of ion-exchange water, and then dispersed by means of an ultrasonic dispersion device (36 KHz, 100 W) for 1 min., thereby to prepare an aqueous dispersion medium. In this aqueous dispersion medium, the proportion of particles having a particle size of 10 μm or larger was about 60 wt. %.

A polymerization toner was prepared in the same manner as in Example 3, except for using the aqueous dispersion medium prepared above. The resultant toner showed a volume-average particle size of 10.7μ, and contained 15% by volume of coarse particles with sizes over 16μ.

By using the thus prepared polymerization toner, image formation was effected in the same manner as in Example 3 under conditions of 23° C. and 60% RH whereby a somewhat coarse image was obtained.

Further, image formation was effected in the same manner under high temperature-high humidity conditions (32.5° C.-90% RH, and 32.5° C.-85% RH), whereby only a coarse image having low image density was obtained.

COMPARATIVE EXAMPLE 2

An aqueous dispersion medium was prepared in the same manner as in Comparative Example 1 except that 10.3 g of the treated silica was charged to 1200 ml of ion-exchange water and stirred by means of a TK-homomixer for 10 min. at 10,000 rpm. In this aqueous dispersion medium, the proportion of particles having a particle size of 10 μm or above was about 60 wt. %.

A polymerization toner was prepared in the same manner as in Example 3, except for using the aqueous dispersion medium prepared above. The resultant toner showed a volume-average particle size of 10.7μ, and contained 16% by volume of coarse particles with sizes over 16μ.

By using the thus prepared polymerization toner, image formation was effected in the same manner as in Example 3 under conditions of 23° C. and 60% RH whereby a somewhat coarse image was obtained.

Further, image formation was effected in the same manner under high temperature-high humidity conditions (32.5° C.-90% RH, and 32.5° C.-85% RH), whereby only a coarse image having low image density was obtained.

EXAMPLE 4

10 g of colloidal silica (#200, mfd. by Nihon Aerosil K.K.) was charged to 1000 ml of ion-exchange water, and dispersed for 10 min. at 10,000 rpm by means of a TK-homomixer (mfd. by Tokushu Kika Kogyo K.K.). Then, 0.5 g of γ-aminopropyltriethyoxysilane was diluted with 200 ml of ion-exchange water, and the resultant mixture was then added to the aqueous medium prepared above, under stirring with the above-mentioned TK-homomixer. After the addition, the resultant mixture was stirred for 10 min., heated up to 60° C. and then further stirred for 10 min.

The particle size of the thus prepared colloidal silica in a dispersion state was measured by means of a Coulter counter. As a result, in the particle size distribution by number, the proportion of particles having a particle size of 3.17 μm or larger was 1% by number or less.

To the thus prepared aqueous medium, 18 g of 1/10N-HCl was added thereby to prepare an aqueous dispersion medium.

A polymerization toner was prepared in the same manner as in Example 2 except that the aqueous dispersion medium prepared above was used. The resultant toner showed a volume-average particle size of 8.5μ, and contained 3% by volume of coarse particles with sizes over 16μ.

By using the thus prepared polymerization toner, image formation was effected in the same manner as in Example 3, whereby an image excellent in image quality and image density was obtained similarly as in Example 3.

COMPARATIVE EXAMPLE 3

An aqueous dispersion medium was prepared in the same manner as in Comparative Example 1 except that colloidal silica was treated with 5 g of γ-aminopropyltriethoxysilane. In the treated colloidal silica, colloidal silica hardly wettable with water was partially present.

The particle size of the thus prepared colloidal silica in a dispersion state was measured by means of a Coulter counter. As a result, in the particle size distribution by volume, particles having a particle size of 10 μm or larger was contained in an amount of 60 wt. % or more. Further, in a particle size distribution by number, the proportion of particles having a particle size of 5.04 μm or larger was 30% by number.

A polymerization toner was prepared in the same manner as in Comparative Example 1, except for using the aqueous dispersion medium prepared above. By using the thus prepared polymerization toner, image formation was effected in the same manner as in Comparative Example 1, whereby only a similar result as Comparative Example 1 was obtained.

EXAMPLE 5

10 g of colloidal silica (#200, mfd. by Nihon Aerosil K.K.) was charged to 1000 ml of ion-exchange water adjusted to pH 3.5–4.0 by hydrochloric acid, and dispersed for 10 min. at 10,000 rpm by means of a TK-homomixer (mfd. by Tokushu Kika Kogyo K.K.). Then, 0.2 g of methyltrimethoxysilane, was diluted with 200 ml of ion-exchange water adjusted to pH 3.5–4.0 as described above, and the resultant mixture was dissolved under stirring for 20 min. Thereafter, the resultant coupling agent solution was added to the aqueous medium prepared above, unde stirring with the above-mentioned TK-homomixer. After the addition, the resultant mixture was stirred for 10 min., heated up to 60° C. and then further stirred for 10 min.

The particle size of the thus prepared colloidal silica in a dispersion state was measured by means of a Coulter counter. As a result, in the particle size distribution by number, the proportion of particles having a particle size of 3.17 μm or larger was 1% by number or less.

A polymerization toner was prepared in the same manner as in Example 3 except that the aqueous dispersion medium prepared above was used. The resultant toner showed a volume-average particle size of 9.5μ, and contained 3% by volume of coarse particles with sizes over 16μ.

By using the thus prepared polymerization toner, image formation was effected in the same manner as in Example 2, whereby an image excellent in image quality and image density was obtained similarly as in Example 2.

COMPARATIVE EXAMPLE 4

20 ml of a methanol solution containing 0.3 g of γ-aminopropyltriethoxysilane was dropped to 10 g of colloidal silica (#200, mfd. by Nihon Aerosil K.K.) under stirring. After the dropping, the resultant mixture was heat-treated at 120° C. under stirring thereby to prepare colloidal silica surface-treated with the γ-aminopropyltriethoxysilane.

An aqueous dispersion medium was prepared in the same manner as in Example 1 except that the thus treated silica was charged to 1000 ml of ion-exchange water. In the particle size distribution by number of the treated colloidal silica in this aqueous dispersion medium, it was found that the proportion of particles having a particle size of 10 μm or above was about 40 wt. %.

A polymerization toner was prepared through suspension polymerization in the same manner as in Example 1, except for using the aqueous dispersion medium prepared above. The resultant toner showed a volume-average particle size of 8.5μ, and a number-average particle size of 6.1 μm, and contained 10 wt. % of coarse particles with sizes over 10μ.

By using the thus prepared polymerization toner, image-formation was effected in the same manner as in Example 1. As a result, under high temperature-high humidity conditions, fog was pronounced as compared with Example 1.

COMPARATIVE EXAMPLE 5

A polymerization toner was prepared in the same manner as in Example 1, except that an aqueous dispersion medium prepared in the same manner as in Comparative Example 4 was used and the colloidal silica after suspension polymerization was dissolved by using 28 g of sodium hydroxide and stirring for 6 hours at room temperature.

By using the thus prepared polymerization toner, image fommation was effected in the same manner as in Example 1. As a result, under high temperature-high humidity conditions, it was found that the resolution was somewhat low and the image was somewhat rough as compared with Example 1.

What is claimed is:

1. A process for producing a toner through suspension polymerization, comprising:

(a) stirring at least water, hardly water-soluble inorganic fine powder and a compound selected from the group consisting of a silane coupling agent, a titanate-type coupling agent, an aluminate-type coupling agent, a zircoaluminate-type coupling agent and hydrolysis products thereof, thereby to prepare an aqueous dispersion medium;

(b) adding a polymerizable monomer composition comprising at least a polymerizable monomer and a polymerization initiator to the aqueous dispersion medium;

(c) forming particles of the polymerizable monomer composition in the aqueous dispersion medium;

(d) subjecting the particles of the polymerizable monomer composition to suspension polymerization, thereby to produce toner particles; and (e) removing the hardly water-soluble inorganic fine powder attached to the surfaces of the toner particles by an aqueous alkaline or acidic solution.

2. A process according to claim 1, wherein the hardly water-soluble inorganic fine powder is added to water and stirred, and then said compound is added to the water cotaining the inorganic fine powder and stirred, thereby to prepare the aqueous dispersion medium.

3. A process according to claim 1, wherein said hydrolysis product is prepared by mixing the silane coupling agent, the titanate-type coupling agent, the aluminate-type coupling agent or zircoaluminate-type coupling agent, with water.

4. A process according to claim 1, wherein said compound is the silane coupling agent or the hydrolysis product thereof.

5. A process according to claim 4, wherein said compound is a nitrogen-containing silane coupling agent having an alkoxy group.

6. A process according to claim 5, wherein the silane coupling agent comprises a compound selected from the group consisting of γ-(2-aminoethyl)aminopropyltrimethoxysilane, γ-(2-aminoethyl)aminopropylmethyldimethoxysilane, octadecyldimethyl[3-(trimethoxysilyl)propyl]ammonium chloride, and γ-aminopropyltriethoxysilane.

7. A process according to claim 1, wherein the hardly water-soluble inorganic fine powder has a solubility of 100 mg or less in 100 g of water.

8. A process according to claim 7, wherein the hardly water-soluble inorganic fine powder has a solubility of 50 mg or less in 100 g of water.

9. A process according to claim 8, wherein the hardly water-soluble inorganic fine powder comprises an inorganic compound selected from the group consisting of barium carbonate ($BaCO_3$), calcium carbonate ($CaCO_3$), calcium phosphate ($Ca_3(PO_4)_2$), colloidal silica, aluminum oxide ($Al_2O_3$), and titanium oxide.

10. A process according to claim 1, wherein the aqueous dispersion medium is used in an amount of 200–1000 wt. parts, per 100 wt. parts of the polymerizable monomer composition.

11. A process according to claim 1, wherein the hardly water-soluble inorganic fine powder is added to the aqueous dispersion medium in an amount of 1–20 wt. %, based on the weight of the polymerizable monomer composition.

12. A process according to claim 11, wherein the hardly water-soluble inorganic fine powder is added to the aqueous dispersion medium in an amount of 3–10 wt. %, based on the weight of the polymerizable monomer composition.

13. A process according to claim 1, wherein the polymerizable monomer comprises a vinyl monomer.

14. A process according to claim 13, wherein the polymerizable monomer comprises styrene or a styrene derivative.

15. A process according to claim 13, wherein the polymerizable monomer comprises a mixture of styrene and an alkyl acrylate, an alkyl methacrylate, or an alkyl maleate.

16. A process according to claim 1, wherein the aqueous dispersion medium is stirred by means of a high shearing force stirrer.

17. A process according to claim 1, wherein the polymerizable monomer composition comprises a polymerizable monomer, colorant or magnetic powder, and a polymerization initiator.

18. A process according to claim 1, wherein colloidal silica is mixed with water to prepare a silica dispersion, a silane coupling agent diluted with water is added to the silica dispersion and stirred to prepare an aqueous dispersion medium, and a Broensted acid is further added to the aqueous dispersion medium.

19. A process according to claim 18, wherein the Broensted acid comprises hydrochloric acid.

20. A process according to claim 18, wherein the aqueous dispersion medium is mixed with a polymerizable monomer composition which comprses a polymerizable monomer, colorant or magnetic powder, a polymerization initiator, and an anionic polymer, an anionic copolymer or cyclized rubber, by means of a high shearing force stirrer; the resultant mixture is subjected to suspension polymerization to prepare toner particles; and the colloidal silica attached to the surfaces of the toner particles is removed by an aqueous alkaline solution.

21. A process according to claim 20, wherein the aqueous alkaline solution is prepared by adding sodium hydroxide to the aqueous dispersion medium.

22. A process according to claim 21, wherein the sodium hydroxide is used in an amount of more than 1 to 3.5 equivalents, per 1 equivalent of the colloidal silica.

* * * * *

UNITED STATES PATENT AND TRADEMARK OFFICE

CERTIFICATE OF CORRECTION

PATENT NO. : 4,816,366

DATED : March 28, 1989

INVENTOR(S) : Yoshihiko Hyosu, et al.

It is certified that error appears in the above-identified patent and that said Letters Patent is hereby corrected as shown below:

Column 8, line 58, "0.2 10 parts)," should read --0.2-10 parts),--.

Column 18, line 42, "1-stainless steel" should read --ℓ-stainless steel--.

Column 20, line 55, "1-stainless steel" should read --ℓ-stainless steel--.

Column 24, line 37, "cotaining" should read --containing--.

Signed and Sealed this

Thirteenth Day of March, 1990

*Attest:*

JEFFREY M. SAMUELS

*Attesting Officer*

*Acting Commissioner of Patents and Trademarks*